US011598235B2

(12) United States Patent
Kavnekar et al.

(10) Patent No.: US 11,598,235 B2
(45) Date of Patent: Mar. 7, 2023

(54) INTERNAL COMBUSTION ENGINE WITH INTERNAL OIL HEATING OF BLOWBY GAS

(71) Applicant: Deere & Company, Moline, IL (US)

(72) Inventors: Vijay J. Kavnekar, Pune (IN); Dattatray B. Pingle, Nashik (IN); Randy R. Scarf, Gladbrook, IA (US); David A. Chekas, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 79 days.

(21) Appl. No.: 17/203,501

(22) Filed: Mar. 16, 2021

(65) Prior Publication Data

US 2022/0298938 A1 Sep. 22, 2022

(51) Int. Cl.
*F01M 13/04* (2006.01)

(52) U.S. Cl.
CPC . *F01M 13/0416* (2013.01); *F01M 2013/0461* (2013.01)

(58) Field of Classification Search
CPC ... F01M 2013/0472; F01M 2013/0461; F01M 13/0416; F01P 3/02; F01P 3/12
See application file for complete search history.

(56) References Cited

U.S. PATENT DOCUMENTS 4,458,642 A * 7/1984 Okubo ..... F16N 39/005 184/6.21
4,768,493 A 9/1988 Ohtaka et al.
6,234,154 B1 * 5/2001 Spix ..... F01M 13/04 123/572
11,396,834 B2 * 7/2022 Osada ..... F01M 13/04
2009/0038579 A1 2/2009 Shieh et al.
2020/0200128 A1 * 6/2020 Sakuma ..... B01D 50/20

FOREIGN PATENT DOCUMENTS

CN 206054036 U 3/2017
CN 206707812 U 12/2017
CN 207437162 U 6/2018
CN 208982140 U 6/2019
CN 110145383 A 8/2019

OTHER PUBLICATIONS

Image of Kubota Engine with Heater, undated, admitted prior art. (1 page).
Cummins Filtration, Fleetguard Crankcase Ventilation Manager CVM280 and CVM424 Brochure, Crankcase Ventilation Blow-by Gas Management for Emissions Compliance and a Cleaner Environment, LT36168GB, © 2010 Cummins Filtration Inc. (4 pages).

* cited by examiner

*Primary Examiner* — Kevin A Lathers
(74) *Attorney, Agent, or Firm* — Klintworth & Rozenblat IP LLP

(57) ABSTRACT

An internal combustion engine includes a crankcase with a plurality of piston-cylinder arrangements and a valve head positioned above the crankcase at least in part containing a valve train. The internal combustion engine further includes a head cover coupled to the valve head and having a blowby outlet and a baffle positioned between the head cover and the crankcase and defining an oil passage internal to the baffle. Engine oil circulates through the oil passage of the baffle to transfer heat to blowby gas flowing from one or more of the plurality of piston-cylinder arrangements before exiting the valve head through the blowby outlet in the head cover.

20 Claims, 10 Drawing Sheets

INTERNAL COMBUSTION ENGINE WITH INTERNAL OIL HEATING OF BLOWBY GAS

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to internal combustion engines and, more particularly, to the ventilation of blowby gases from such engines.

BACKGROUND OF THE DISCLOSURE

Internal combustion engines have a series of pistons reciprocating within associated combustion cylinders. These pistons are connected to a crankshaft to translate the reciprocating movement to a rotary output. Reciprocating internal combustion engines may have some degree of gases that pass by the pistons from the combustion chamber to the crankcase of the engine, with this gas typically referred to as "blowby gas." This blowby gas would buildup in the crankcase unless vented. While some engine designs may vent the blowby gases directly to the atmosphere, more recent engine designs include a crankcase ventilation system to vent the blowby gas out from the crankcase. The blowby gas may be treated before venting the gas to the atmosphere (an open crankcase design) or routing the gas back to a turbocharger compressor (a closed crankcase design), such as by routing the blowby gas through a filter assembly that separates oil particles from the blowby gas.

SUMMARY OF THE DISCLOSURE

An internal combustion engine is disclosed. The internal combustion engine includes a crankcase with a plurality of piston-cylinder arrangements and a valve head positioned above the crankcase at least in part containing a valve train. The internal combustion engine further includes a head cover coupled to the valve head and having a blowby outlet and a baffle positioned between the head cover and the crankcase and defining an oil passage internal to the baffle. Engine oil circulates through the oil passage of the baffle to transfer heat to blowby gas flowing from one or more of the plurality of piston-cylinder arrangements before exiting the valve head through the blowby outlet in the head cover.

In another implementation, an internal combustion engine includes a crankcase with a plurality of piston-cylinder arrangements and a valve head positioned above the crankcase at least in part containing a valve train. The internal combustion engine further includes a head cover coupled to the valve head and having a blowby outlet formed therein to vent blowby gas flowing from one or more of the plurality of piston-cylinder arrangements and a baffle coupled to a bottom side of the head cover and adjacent the blowby outlet, the baffle defining an oil passage internal to the baffle. Engine oil circulates through the oil passage of the baffle to transfer heat to the blowby gas before exiting the valve head through the blowby outlet in the head cover.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
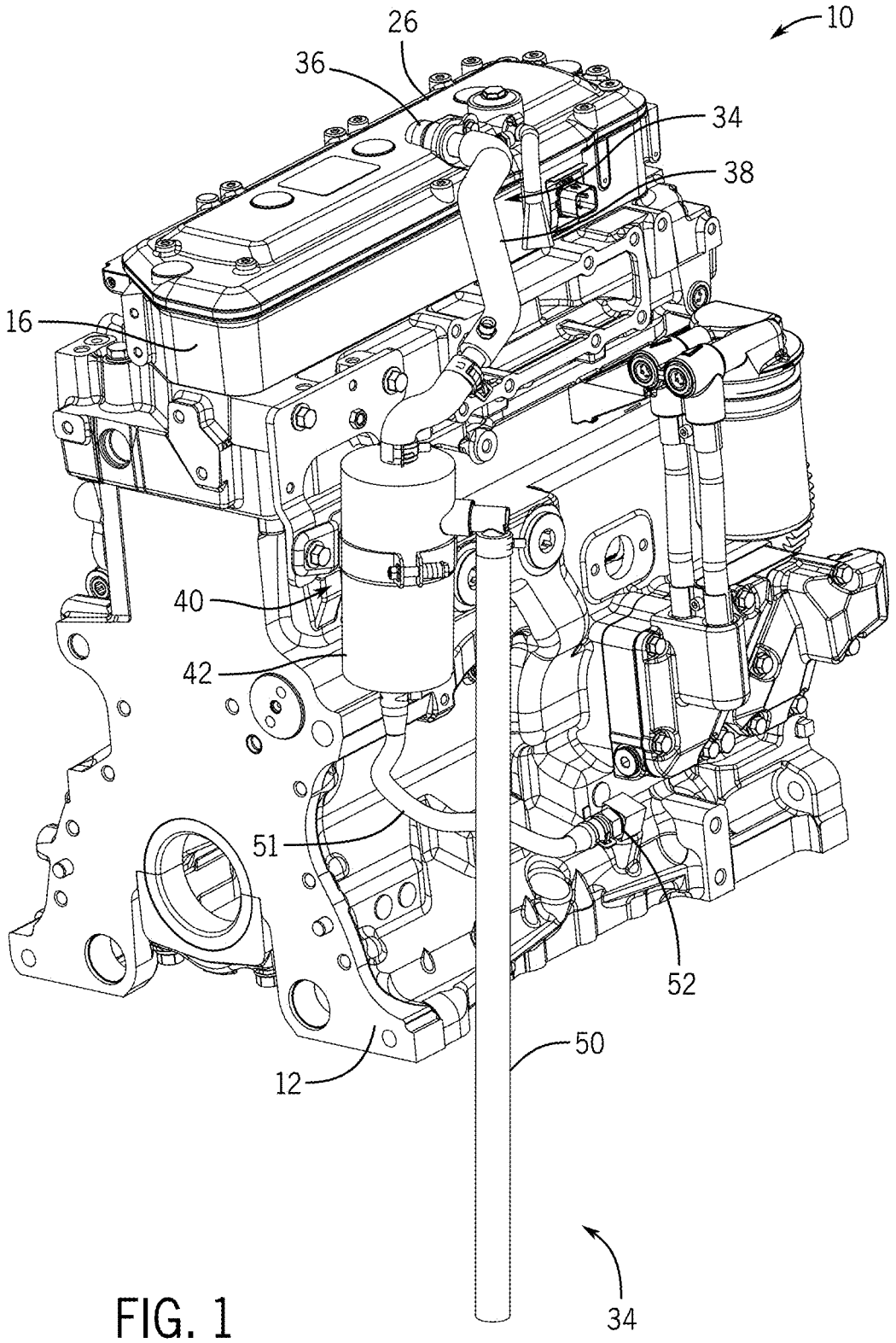
FIG. 1 is an isometric view of an example internal combustion engine with a crankcase ventilation system that implements engine oil heating of blowby gases within the engine in accordance with an embodiment.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as set-forth the appended claims.

Overview

As previously noted, operation of a reciprocating internal combustion engine generates blowby gas that passes by the pistons from the combustion chamber to the crankcase of the engine. The blowby gas migrates from the crankcase up to a valve head of the engine through a plurality of passages present in the engine, such as passages for pushrods going down to a lower mounted camshaft and/or defined passages for oil from a rocker shaft and rocker arm assembly to return back down to the oil sump at the bottom of the of the crankcase. A crankcase ventilation system for the engine functions to remove blowby gas that migrates to the valve head via a blowby gas outlet formed in a cover positioned above the valve head. Blowby gas that exits out the blowby gas outlet is routed via an attached conduit to a filter assembly that separates oil particles from the blowby gas. The separated oil particles are returned back to the sump in the crankcase and the filtered blowby gas is vented to the atmosphere or routed back to an inlet turbocharger compressor, depending on whether the engine has an open crankcase ventilation or closed crankcase ventilation design.

It is recognized that internal combustion engines may sometimes be operated in environments where the ambient temperature may drop well below freezing, such as from −10 to −40° C. for example, with internal combustion engines on snow-clearing vehicles, agricultural machines, and other work vehicles being examples. In such extreme conditions, crankcase ventilation systems may experience issues with oil and/or water vapors in the blowby gas freezing after being vented out from the valve head. This freezing of vapors in the blowby gas may cause ice to form and accumulate in the filter assembly (within filter cavities and at the filter inlet) and in an exhaust tube that vents the blowby gas to atmosphere after passing through the filter assembly. Freezing of vapors in the blowby gas may also cause oil slurry, or an oil and water sludge, to form in the filter assembly.

As a result of this freezing of oil and/or water vapors in the blowby gas, performance issues in the vehicle or machine may arise. For example, the accumulation of ice or oil slurry in the filter assembly may result in clogging that blocks the flow of blowby gas therethrough. The clogging of the filter assembly may, in turn, cause an increase in the blowby gas pressure within the crankcase, resulting in the generation of a fault code by the engine control unit that de-rates the engine and/or otherwise inhibits operation of the vehicle/machine while in the field of operation.

To prevent the freezing of oil and water vapors in the blowby gas during operation and reduce the occurrences of associated fault codes being generated, an internal combustion engine and associated crankcase ventilation system are provided. Specifically, a crankcase ventilation system is provided that uses engine oil to heat the blowby gas prior to the gas exiting the blowby gas outlet in the head cover. Heating of the blowby gas to a higher temperature prior to the gas exiting the blowby gas outlet in the head cover aids in preventing oil and water vapors in the blowby gas from freezing as the gas passes through the filter assembly and is vented to the atmosphere (or returned to an inlet of a turbocharger compressor).

In an embodiment, an internal combustion engine is provided having a baffle therein, with engine oil being circulated through an internal oil passage of the baffle. The baffle is positioned between the crankcase and the head cover, such that it is in the path of the blowby gas as it migrates up from the crankcase, to the valve head of the engine, and out through the blowby gas outlet in the head cover. The baffle is formed from a thermally conductive, metallic material such that, when blowby gas is passed over the baffle prior to exiting the blowby gas outlet, heat is transferred from the engine oil, to the baffle, and on to the blowby gas.

In operation of the internal combustion engine, engine oil is circulated through an engine oil circuit such that engine oil flows from a sump in the crankcase and to up to the baffle. According to example embodiments, the engine oil circuit may direct a flow of engine oil directly from the sump to the baffle or may direct a flow of engine oil from the sump, through an oil cooler, and then on to the baffle.

According to an implementation where the engine oil flows from the sump and then through an oil cooler before circulating to the baffle, some or all of this engine oil may also be provided to a rocker shaft associated with the valve head via use of a rocker shaft clamp. In one configuration, oil flow received by the rocker shaft clamp is divided along two flow passages therein, with one flow passage providing a portion of engine oil to the baffle and the other flow passage providing a portion of engine oil to the rocker shaft. In another configuration, oil flow received by the rocker shaft clamp is passed through a single oil flow passage therein to the baffle, with engine oil passing through the internal oil passage of the baffle and then passing on to the rocker shaft.

According to one example embodiment, the baffle is connected to an underside of the head cover. The bottom side of the head cover and a top surface of the baffle define a blowby passage through which blowby gas flows from the valve head of the engine to the blowby outlet in the head cover. The bottom side of the head cover may include a plurality of blowby gas guides formed thereon that, along with the top surface of the baffle, define a serpentine-shaped blowby passage.

Example embodiments of an internal combustion engine having an engine oil-heated baffle guide as part of a crankcase ventilation system will now be described in conjunction with FIGS. 1-9 according to this disclosure. By way of non-limiting examples, the following describes the engine as having a crankcase ventilation system configured as an open crankcase type ventilation system. The following examples notwithstanding, internal combustion engines with closed crankcase type ventilation systems would also benefit from an engine oil-heated baffle guide of the invention being incorporated therein according to aspects of the invention. It is therefore recognized that aspects of the invention are not meant to be limited only to the specific embodiments described hereafter.

Figure 2:
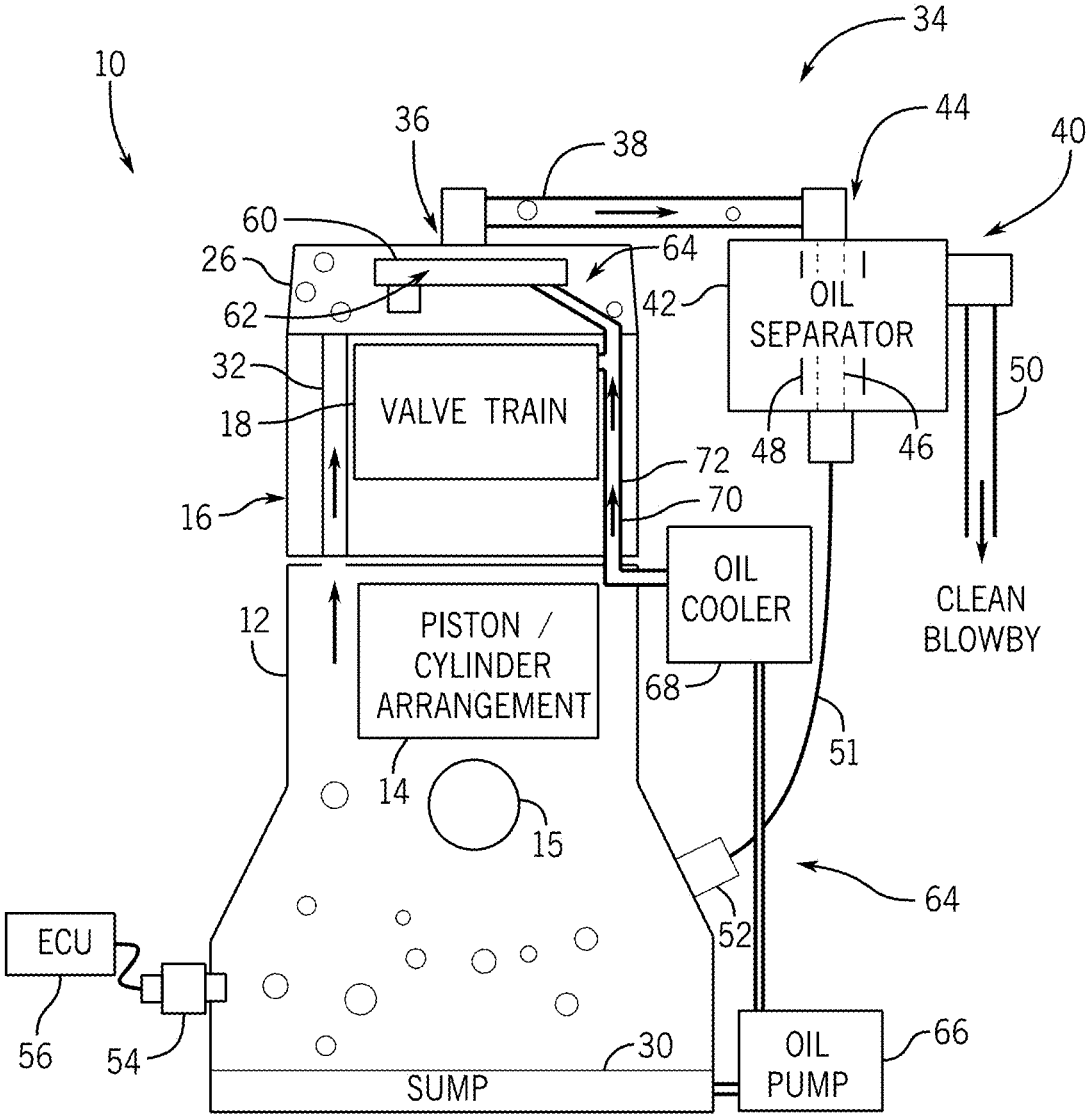
FIG. 2 is a schematic diagram of the internal combustion engine of FIG. 1 and an example engine oil circuit included therein.

Example Embodiment(s) of an Internal Combustion Engine with Internal Oil Heating of Blowby Gas With initial reference to FIGS. 1 and 2, an internal combustion engine 10 is illustrated in accordance with an embodiment. The engine 10 may be a gasoline or diesel engine and may be of any size, have any number cylinders, and be of any configuration. The engine 10 has a crankcase 12 in which a series of piston-cylinder arrangements 14 is provided, with the pistons reciprocating within the cylinders to drive a crankshaft 15 that provides a rotary output. Positioned over the crankcase 12 (i.e., on an engine block in the crankcase 12) is a valve head 16 that includes a valve train 18 therein that admits intake air and permits the discharge of exhaust air from the cylinders of the piston-cylinder arrangements 14. According to embodiments, the engine 10 may be configured as an overhead valve engine where a camshaft (not shown) is located in the crankcase 12 and actuates valves in the valve train 18 through a transfer of motion therefrom to the valves via pushrods and rocker arms, or as an overhead camshaft engine where a camshaft is located in the valve head 16 (above the crankcase 12) and actuates valves in the valve train 18 through a transfer of motion directly therefrom to the valves. Herebelow, the engine 10 will be shown and described as an overhead valve engine that includes a set of rocker arms mounted on a rocker shaft in or adjacent the valve head 16 to provide for opening and closing the valves in the valve train 18 responsive to actuation of the rocker arms by pushrods. However, it is recognized that aspects of the invention could be incorporated into an overhead camshaft engine rather than an overhead valve engine, and that the overhead valve engine illustrated and described hereafter presents only one example configuration.

As shown in FIGS. 1 and 2, a head cover 26 is affixed to a top of the valve head 16 that, along with the valve head 16 and crankcase 12, generally define an enclosed volume within the engine 10. As discussed previously, internal combustion engines have a bypass flow of gases from the piston-cylinder arrangements of the engine known as blowby gases. The blowby gases are a normal part of the engine operating cycle and are caused by piston ring reversals and the passage of gases across the end gaps of piston rings. The blowby gases travel from combustion chambers in the piston-cylinder arrangements 14 and past the pistons to the lower portion of crankcase 12, which houses the oil sump 30 for the engine 10. A number of passages 32 are formed through components in the crankcase 12 and the valve head 16, including passages for the pushrods 24 going down to a lower mounted camshaft (not shown) and defined paths for oil from the valve head 16 to drain back down to the sump 30. These passages 32 allow for blowby gas to migrate up from the crankcase 12 and through the valve head 16 of the engine 10 to prevent build-up of the blowby gas within the crankcase 12.

A crankcase ventilation system 34 is included in the engine 10 to remove blowby gas that migrates to an area above the valve head 16 and treat the blowby gas prior to being vented to the atmosphere. A blowby outlet 36 is formed in the head cover 26 through which blowby gas exits the engine 10. A conduit 38 is connected to the blowby outlet 36 and extends outward therefrom to provide a flow path for the blowby gas. A second end of the conduit 38 is connected to a filter assembly 40 that functions to remove oil droplets or vapor from the blowby gas prior to the gas being vented to the atmosphere. In one embodiment, the filter assembly 40 includes a canister 42 with a central opening 44 to which the conduit 38 is connected to introduce blowby gas into the filter assembly 40. The blowby gas may be routed through a perforated central stem 46 inside the canister 42, with the blowby gas and oil droplets therein flowing out through the central stem 46 to be passed through a cylindrical coalescing filter 48 that causes the fine droplets of oil to coalesce to the point where they no longer are carried in the blowby gas stream and instead are allowed to flow by gravity downwardly to the bottom of the canister 42. The blowby gas depleted of oil exits the top of the canister 42 (i.e., vented to the atmosphere) through an outlet hose 50 that is located near the top and offset outwardly from the coalescing filter 48, while the oil removed from the blowby gas by the coalescing filter 48 drains to a compartment in the bottom of the canister 42. This oil accumulates in the compartment and is diverted out therefrom to be routed back to the sump 30, with a drain hose 51 leading from the filter assembly 40 back to the crankcase 12 and a check valve 52 regulating and controlling the return flow of oil back to the sump 30.

In venting blowby gas out through conduit 38 and filter assembly 40, it is recognized that the blowby gas may be susceptible to freezing (i.e., water/oil vapors in the gas may freeze) when the engine 10 is being operated in environmental conditions where the temperature is at or below −10° C. for example. This freezing of water/oil vapors in the blowby gas can lead to a build-up of ice or oil slurry in the filter assembly 40 and the outlet hose 50 that results in clogging that blocks the flow of blowby gas therethrough. The clogging of the filter assembly 40 or outlet hose 50 may, in turn, cause an increase in the blowby gas pressure within the crankcase 12 that may be sensed by a crankcase pressure sensor 54. The readings acquired by the crankcase pressure sensor 54 may be read by an engine control unit (ECU) 56 that operates the engine 10, and, when the blowby gas pressure within the crankcase 12 exceeds a threshold value, a fault code may be generated by the ECU 56 that results in a de-rating of the engine 10 that can inhibit operation thereof.

To prevent the freezing of oil and water vapors in the blowby gas during operation and reduce the occurrences of associated fault codes being generated, the engine 10 includes an oil-heated baffle 60 that operates to heat the blowby gas prior to it exiting the engine 10 through the blowby outlet 36 in the head cover 26. As shown in FIG. 2, the baffle 60 is positioned between the head cover 26 and the crankcase 12 such that it is adjacent the blowby outlet 36. Accordingly, as blowby gas migrates up from the crankcase 12 to an area above the valve head 16 and then out through blowby outlet 36, the blowby gas passes around and over the baffle 60 to be in thermal contact therewith. Accordingly, the blowby gas passes over the baffle 60 and is heated by engine oil that is being circulated through an oil passage 62 internal to the baffle 60 prior to the blowby gas exiting the blowby outlet 36. To aid in the heat transfer between the engine oil and the blowby gas, the baffle 60 is formed from a thermally conductive material, such as a thermally conductive metal (e.g., copper) or a thermally conductive plastic or composite, as examples. Thus, when blowby gas is passed over the baffle 60, heat is transferred from the engine oil, to the baffle 60, and on to the blowby gas.

An engine oil circuit 64 is included in the engine 10 to provide engine oil to the baffle 60, with a portion of the circuit being shown in FIG. 2. Engine oil may be drawn from the sump 30 in crankcase 12 via an oil pump 66 and passed through an oil cooler 68 associated with the engine 10. A flow of engine oil generated by the oil pump 66 and passed through the oil cooler 68 is then provided to a rising line 70 formed in the engine 10. The rising line 70 may extend through a portion of the crankcase 12 and through the valve head 16. In one embodiment, the rising line 70 is provided in the valve head 16 by drilling a rectilinear passage through the valve head 16. The engine oil may enter the rising line 70 of the engine oil circuit 64, as shown by arrow 72 and pass through the valve head 16 before being passed onto the baffle 60 according to one of a number of configurations that will be explained in greater detail below.

Figure 3:
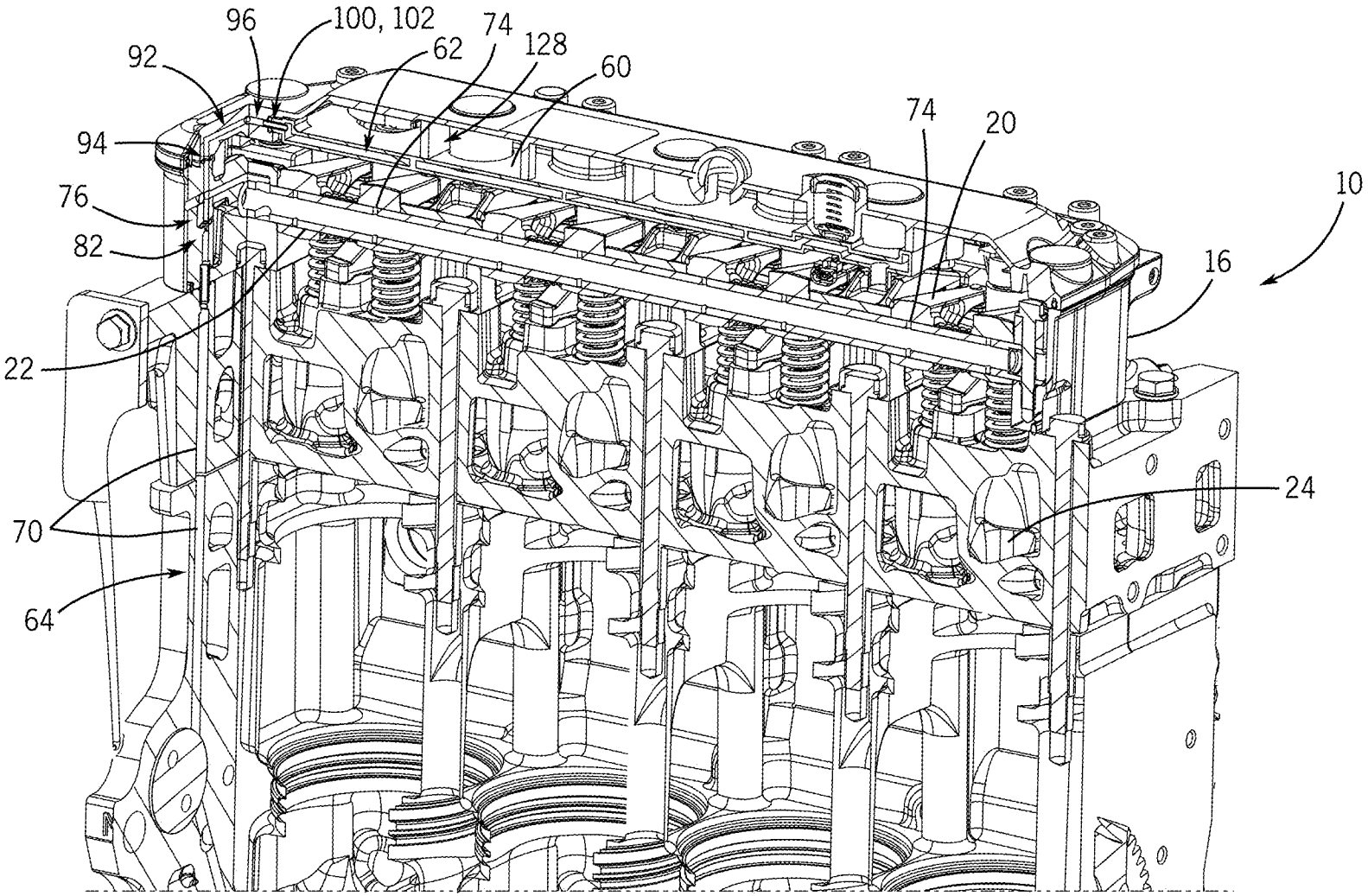
FIG. 3 is a sectional view of the internal combustion engine of FIG. 1, taken along plane 3-3 illustrating the engine oil circuit of FIG. 2 and connection thereof to an engine oil-heated baffle.
Figure 4A:
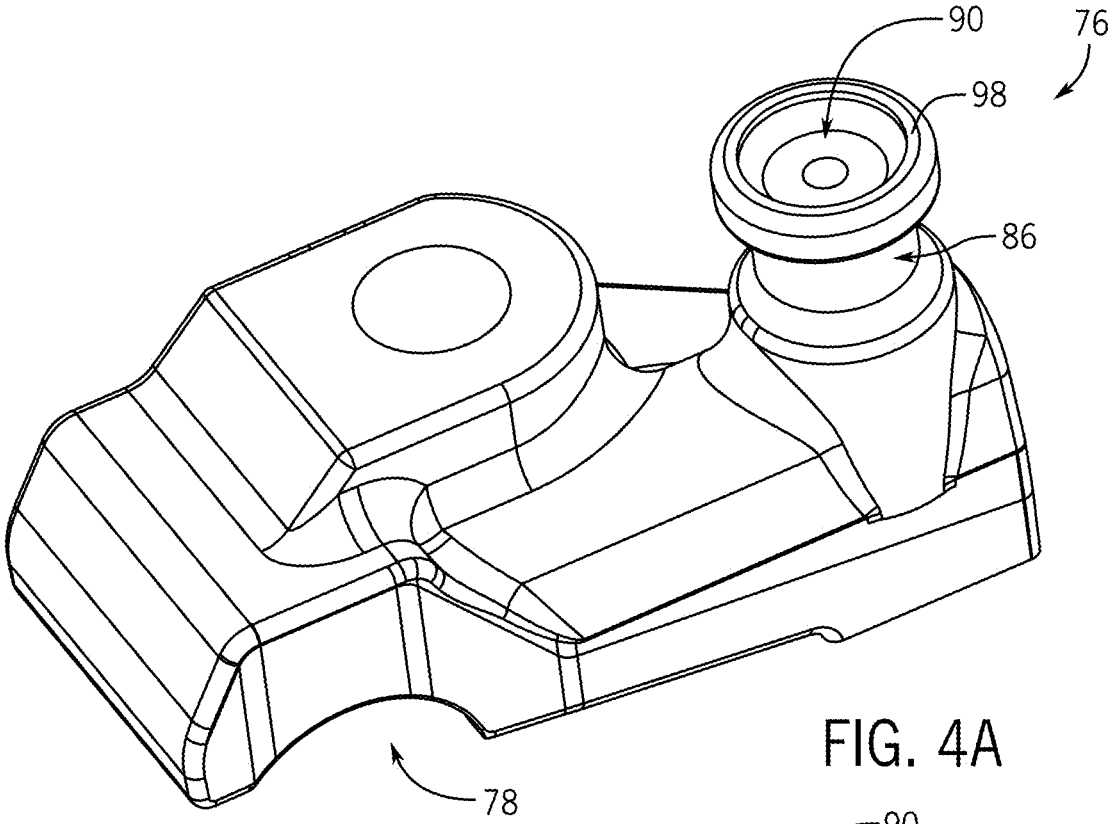
FIGS. 4A and 4B are isometric views of a rocker shaft clamp included in the internal combustion engine.
Figure 4B:
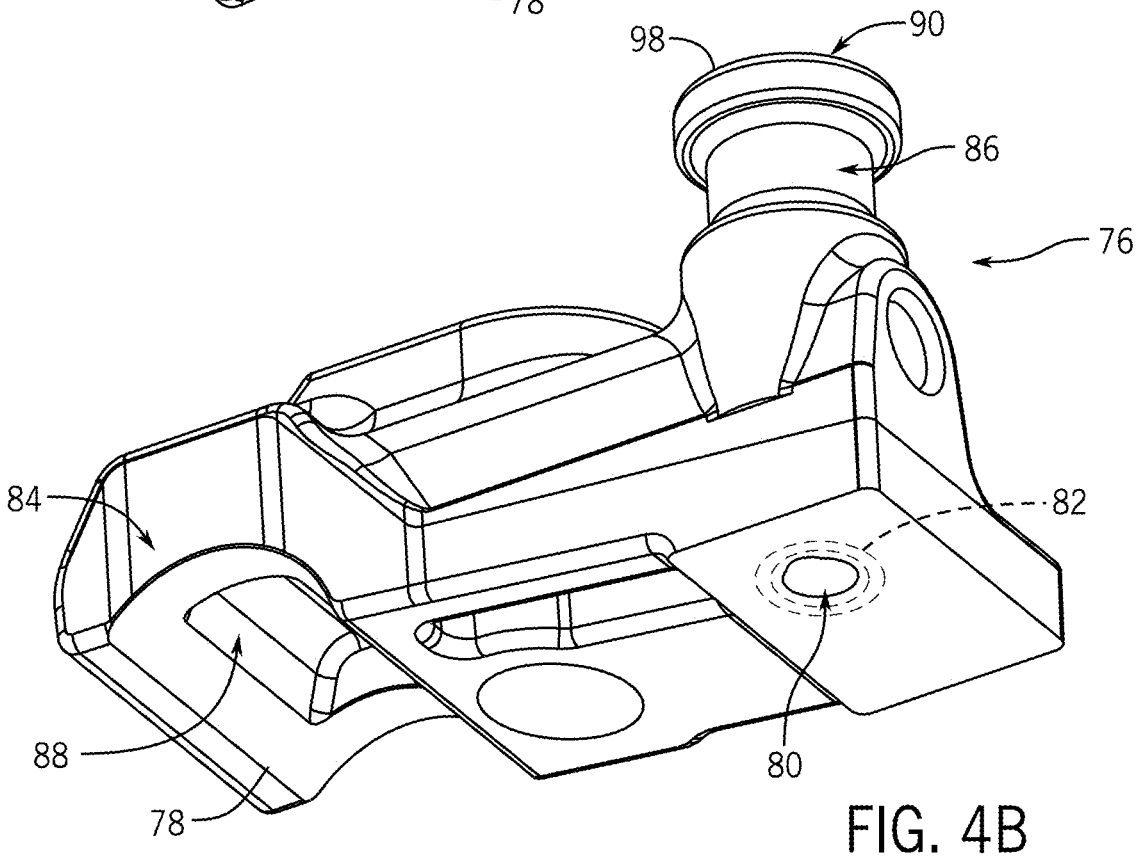

Referring now to FIG. 3, a cross-sectional view of a portion of the engine 10 is provided to better illustrate the internal components thereof, as well as the flow of engine oil along the engine oil circuit 64 and through the baffle 60. As shown therein, a set of rocker arms 20 is mounted on a rocker shaft 22 in/adjacent the valve head 16 to provide for actuating of valves in the valve train 18 of the valve head 16. The opening and closing of valves in the valve train 18 operate the engine 10 to receive intake gas and dispel exhaust gas at precise intervals. Pushrods 24, which may be configured as hollow steel pipes, may be used for actuating the rocker arms 20 (transferring motion thereto from the engine camshaft), with rocker arms 20 moving downward to contact a valve stem tip (not shown) of respective intake or exhaust valves when the pushrods 24 move up. Oil is provided to the rocker shaft 22, which includes holes 74 on a bottom side thereof (aligning with the rocker arms 20) to supply oil into the rocker arms 20 that subsequently drips or is sprayed onto the valve stem tip, while holes in the rocker arms 20 (i.e., in pushrod cups of the rocker arms 20) oil the end of the pushrods 24.

In operation of the engine 10, a flow of engine oil (such as generated by an oil pump 66 in the engine) is provided to the rising line 70 in the engine oil circuit 64, with the rising line 70 allowing for oil to flow up through a portion of the crankcase 12 and through the valve head 16. The engine oil that flows up through the valve head 16 via the rising line 70 is provided to a rocker shaft clamp 76 positioned on a top side of the valve head 16, between the valve head 16 and the head cover 26, with detailed views of the rocker shaft clamp 76 shown in FIGS. 4A and 4B for purposes of discussion. The rocker shaft clamp 76 functions, in part, to mate with the rocker shaft 22 to retain the rocker shaft 22 in place relative to the valve head 16, with a cylindrically shaped groove 78 being formed on the bottom surface of the rocker shaft clamp 76 in which the rocker shaft 22 is seated to help secure the rocker shaft 22 in place. The rocker shaft clamp 76 further functions to direct a flow of engine oil therethrough to provide engine oil to the baffle 60 and also to the rocker shaft 22. The rocker shaft clamp 76 includes a clamp inlet port 80 that is fluidly coupled to the rising line 70 to receive engine oil therefrom, with an O-ring 82 positioned about the clamp inlet port 80 to form a tight seal with an outlet of the rising line 70. From the clamp inlet port 80, a flow of engine oil is divided between a first clamp passage 84 and a second clamp passage 86 formed in an interior of the rocker shaft clamp 76. The first clamp passage 84 directs engine oil to a first clamp outlet port 88 in fluid communication with the rocker shaft 22, while the second clamp passage 86 directs engine oil to a second clamp outlet port 90 in fluid communication with the baffle 60.

The flow of engine oil that flows through the first clamp passage 84 and the second clamp passage 86 in the rocker shaft clamp 76 may be divided by a fixed amount, with the percentage of oil flowing through the clamp passages being determined by the size thereof. In an example embodiment, the second clamp passage 86 is configured as an orifice through which the flow of engine oil is restricted, such that the amount of engine oil that flows through the second clamp passage 86 is less than that which flows through the first clamp passage 84. That is, while the rocker shaft clamp 76 directs a portion of the engine oil to the baffle 60 via second clamp passage 86, it is recognized that a majority of the engine oil is still directed to the rocker shaft 22 via first clamp passage 84 so that a sufficient amount of oil is provided to the valve train 18 to ensure proper engine lubrication and operation. Accordingly, the rocker shaft 22 receives a larger percentage of the engine oil flowing through the engine oil circuit 64 than the baffle 60.

The first clamp outlet port 88 of the rocker shaft clamp 76 is fluidly coupled to the rocker shaft 22, which is configured as a hollow shaft through which engine oil can flow. In one embodiment, the first clamp outlet port 88 is provided in an underside of the cylindrically shaped groove 78 within which the rocker shaft 22 is seated. The engine oil provided to the rocker shaft 22 flows therethrough and then out through holes 74 on the bottom side of the rocker shaft 22 to supply oil into the rocker arms 20 that subsequently drips or is sprayed out therefrom.

The second clamp outlet port 90 of the rocker shaft clamp 76 is fluidly coupled to an oil passage 92 that is formed internally within the head cover 26. According to various configurations where the head cover 26 is a metal component or a plastic component, the oil passage 92 may be cast or molded into the head cover 26, with the oil passage 92 running between an inlet 94 and an outlet 96. An O-ring 98 may be provided about the second clamp outlet port 90 to form a tight seal between the second clamp outlet port 90 and the inlet 94 of the head cover oil passage 92. When the head cover 26 is affixed to the valve head 16, the oil passage 92 is positioned such that it extends between the rocker shaft clamp 76 and the baffle 60 and so that engine oil may be provided to the baffle 60—with an orifice 100 and O-ring 102 positioned at the outlet 96 of the head cover oil passage 92, between the head cover 26 and the baffle 60.

Figure 5A:
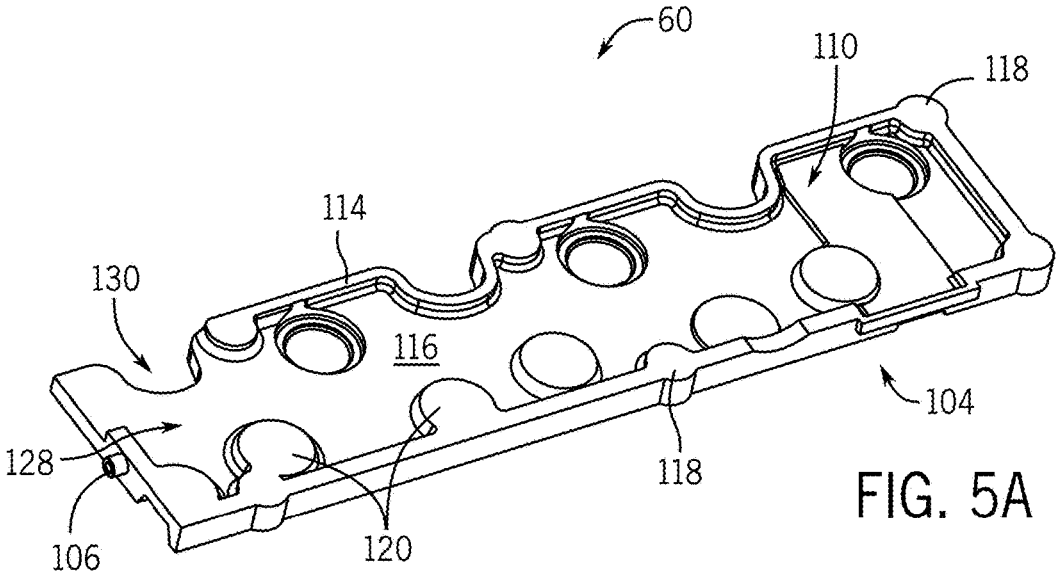
FIGS. 5A-5C are isometric views of the engine oil-heated baffle included in the internal combustion engine of FIG. 1.
Figure 5B:
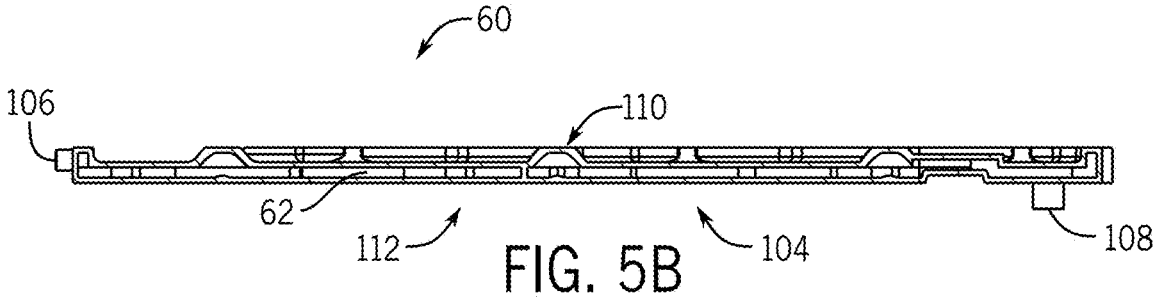
Figure 5C:
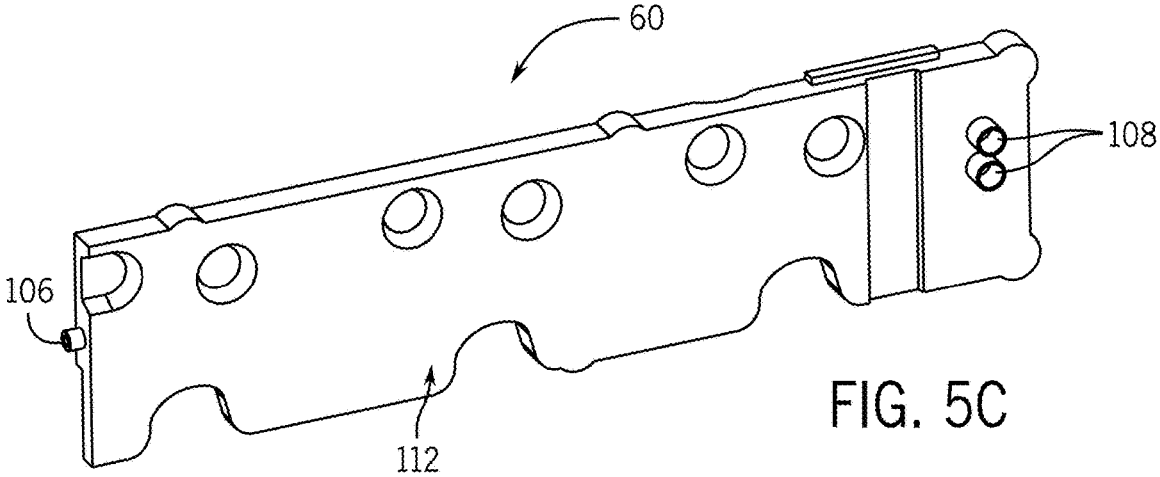

Referring now to FIGS. 5A-5C, views of the baffle 60 are provided to better illustrate internal and external features thereof. The internal oil passage 62 in the baffle 60 may be constructed as a passage within a main body 104 of the baffle 60 that extends a length of the baffle 60 between an oil inlet port 106 and one or more oil outlet ports 108 of the baffle 60. The internal oil passage 62 provides a guided flow path that circulates engine oil from the inlet port 106 to the outlet port(s) 108 in a manner that can maximize a heat transfer between the engine oil and the baffle 60. In one implementation, the internal oil passage 62 accounts for a majority of the volume of the main body 104, such that the baffle 60 is constructed essentially as a hollow member with the internal oil passage 62 sandwiched between upper and lower surfaces 110, 112 of the main body 104. As shown in FIGS. 5B and 5C, the outlet port(s) 108 of the baffle 60 are positioned on the lower surface 112 of the main body 104, such that engine oil that circulates through the baffle 60 easily drains out from the internal oil passage 62 and into the outlet port(s) 108. After exiting the baffle 60 through the outlet port(s) 108, engine oil may then be returned to the sump 30 via additional passages of the engine oil circuit (not shown).

Figure 6A:
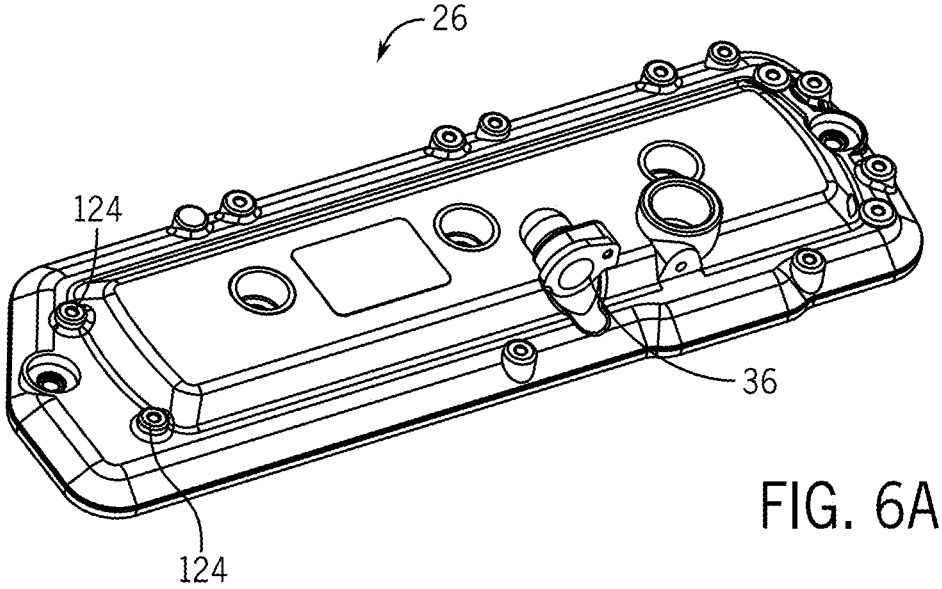
FIGS. 6A and 6B are isometric views of a head cover included in the internal combustion engine of FIG. 1.
Figure 6B:
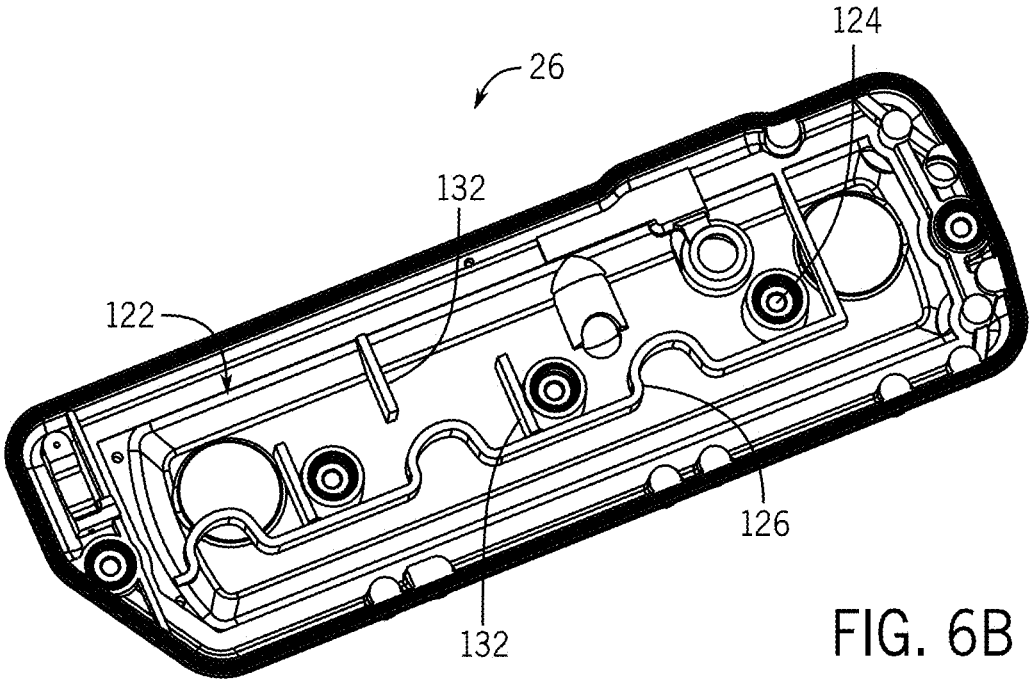

With particular reference to FIG. 5A and now also to FIGS. 6A and 6B, the baffle 60 is further constructed to provide for mounting thereof to the head cover 26, to secure the baffle 60 within the engine 10. The upper surface 110 of the baffle main body 104 includes an outer raised perimeter 114 that surrounds a recessed interior section 116. Positioned about the perimeter 114 are a number of mountings 118 configured to accommodate fasteners therein that secure the baffle 60 to the head cover 26. A number of fitting guides 120, in the form of raised cylindrical protrusions, are also provided on the upper surface of the baffle 60 to allow for easy alignment of the baffle 60 with the head cover 26 when securing the components together. A bottom surface 122 of the head cover 26 (FIG. 6B) includes corresponding mountings 124 and fitting guides 126 that align with the baffle mountings 118 and fitting guides 120, such that the baffle 60 and head cover 26 may be easily aligned and subsequently affixed to each other via the use of fasteners.

When coupled together, the bottom surface 122 of the head cover 26 and the upper surface 110 of the baffle main body 104 form a blowby gas passage 128 therebetween that funnels and guides blowby gas from the interior of the engine 10 toward the blowby outlet 36 formed in the head cover 26. That is, a space/volume is provided between the bottom surface 122 of the head cover 26 and the interior section 116 of the baffle upper surface 110 that provides a blowby gas passage 128 through which blowby gas can flow. A gap 130 in the outer raised perimeter 114 of the baffle main body 104 provides an entry point for blowby gas to flow into the blowby gas passage 128 and, desirably, the gap 130 is positioned at an end of the baffle 60 that is distal from the blowby outlet 36 in the head cover 26, such that a length of the blowby gas passage 128 through which the blowby gas flows is maximized. In one example implementation, the bottom surface 122 of the head cover 26 includes a number of gas guides 132 formed thereon that serve to define a flow path within the blowby gas passage 128. The gas guides 132 may be arranged in a staggered and offset pattern that results in the blowby gas passage 128 having a serpentine shape. The serpentine shape of the blowby gas passage 128 maximizes the length of the flow path as blowby gas flows therethrough, thereby increasing the amount of heat that is transferred from the engine oil, to the baffle 60, and onto the blowby gas, prior to the blowby gas exiting out the blowby outlet 36 of the head cover 26.

Figure 7:
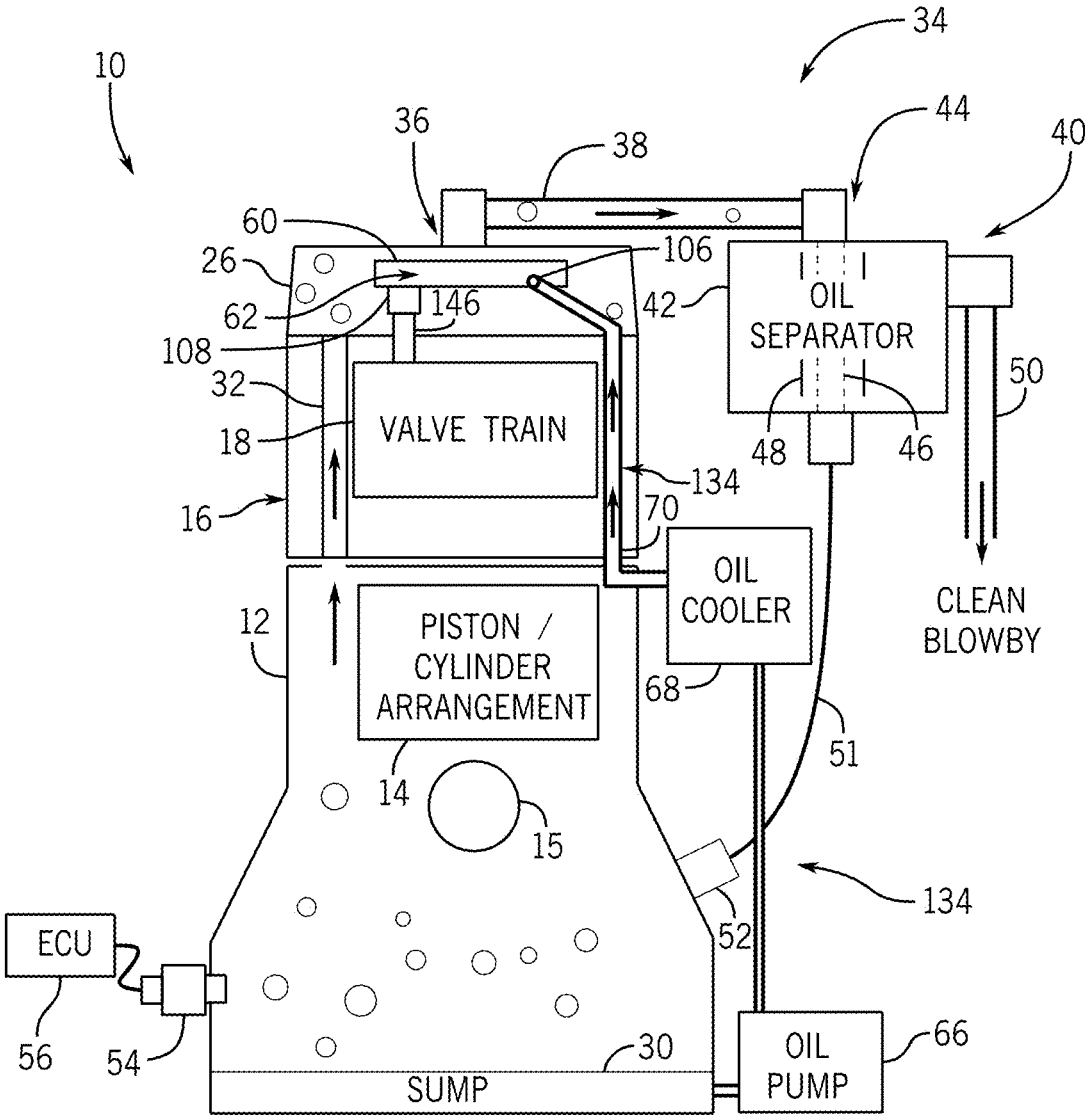
FIG. 7 is a schematic diagram of the internal combustion engine of FIG. 1 and another example engine oil circuit included therein.
Figure 8:
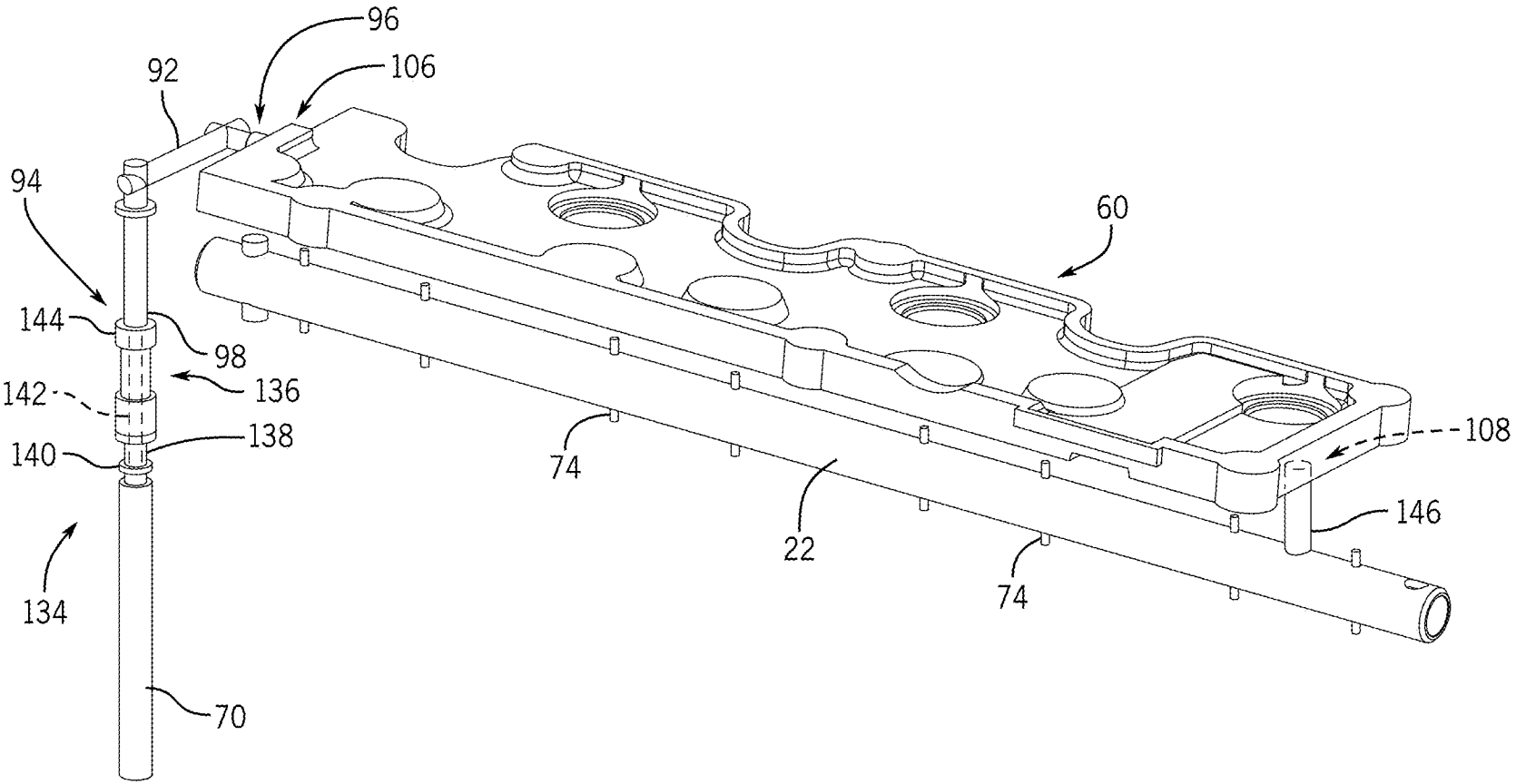
FIG. 8 is an isolated isometric view of a portion of the engine oil circuit of FIG. 7.

It is recognized that the engine oil circuit 64 included in the engine 10 can differ from that shown in FIGS. 2 and 3 according to other implementations, such that engine oil is routed differently to the baffle 60 and valve train 18. FIGS. 7 and 8 illustrate an engine oil circuit 134 included in the engine 10 that directs an entirety of the engine oil flowing in the circuit first to the baffle 60. As shown first in FIG. 7, engine oil may be drawn from the sump 30 in the crankcase 12 via an oil pump 66 and passed through an oil cooler 68 associated with the engine 10. A flow of engine oil generated by the oil pump 66 and passed through the oil cooler 68 is then provided to a rising line 70 formed in the engine 10. The rising line 70 may extend through a portion of the crankcase 12 and through the valve head 16, with engine oil entering the rising line 70 of the engine oil circuit 134 and passing through the valve head 16 before being passed onto the baffle 60.

To direct an entirety of the engine oil in the circuit to the baffle 60, an oil flow guide 136 is provided that receives the engine oil that flows up through the valve head 16 via the rising line 70, as shown in FIG. 8. The oil flow guide 136 may, in one implementation, be configured as a rocker shaft clamp that functions, in part, to mate with the rocker shaft 22 to retain the rocker shaft 22 in place relative to valve head 16. Alternatively, the oil flow guide 136 may function solely to direct a flow of engine oil therethrough without being engaged with or supporting a rocker shaft 22. In either embodiment, the oil flow guide 136 functions to direct a flow of engine oil therethrough to the baffle 60. The oil flow guide 136 includes a guide inlet port 138 that is fluidly coupled to the rising line 70 to receive engine oil therefrom, with an O-ring 140 positioned about the guide inlet port 138 to form a tight seal with an outlet of the rising line 70. From the guide inlet port 138, the engine oil flows through a single guide passage 142 formed in an interior of the oil flow guide 136 and to a guide outlet port 144 in fluid communication with the baffle 60.

The guide outlet port 144 of the oil flow guide 136 is fluidly coupled to the oil passage 92 that is formed internally within the head cover 26. As previously described, the oil passage 92 in the head cover 26 may be formed as part of a casting or molding process, with the oil passage 92 running between an inlet 94 and an outlet 96. An O-ring 98 may be provided about the guide outlet port 144 to form a tight seal between the guide outlet port 144 and the inlet 94 of the head cover oil passage 92. When the head cover 26 is affixed to the valve head 16, the oil passage 92 is positioned such that it extends between the oil flow guide 136 and the baffle 60 and so that engine oil may be provided to the baffle 60—with an orifice 100 and O-ring 102 positioned at the outlet of the head cover oil passage 92, between the head cover 26 and the baffle 60.

As described previously, engine oil circulates through the baffle 60 from the inlet port 106 thereof to the outlet port 108. However, in the engine oil circuit 134 of FIGS. 7 and 8, engine oil that exits the baffle 60 is subsequently provided to the valve train 18 via the rocker shaft 22. A connecting conduit 146 couples the outlet port 108 of the baffle 60 to a rocker shaft inlet 148 in order to provide a flow of engine oil to the rocker shaft 22. The engine oil provided to the rocker shaft 22 flows therethrough and then out through holes 74 on the bottom side of the rocker shaft 22 to supply oil into the rocker arms 20 that subsequently drips or is sprayed out therefrom, with this engine oil eventually flowing back down to the sump 30 of the crankcase 12.

Figure 9:
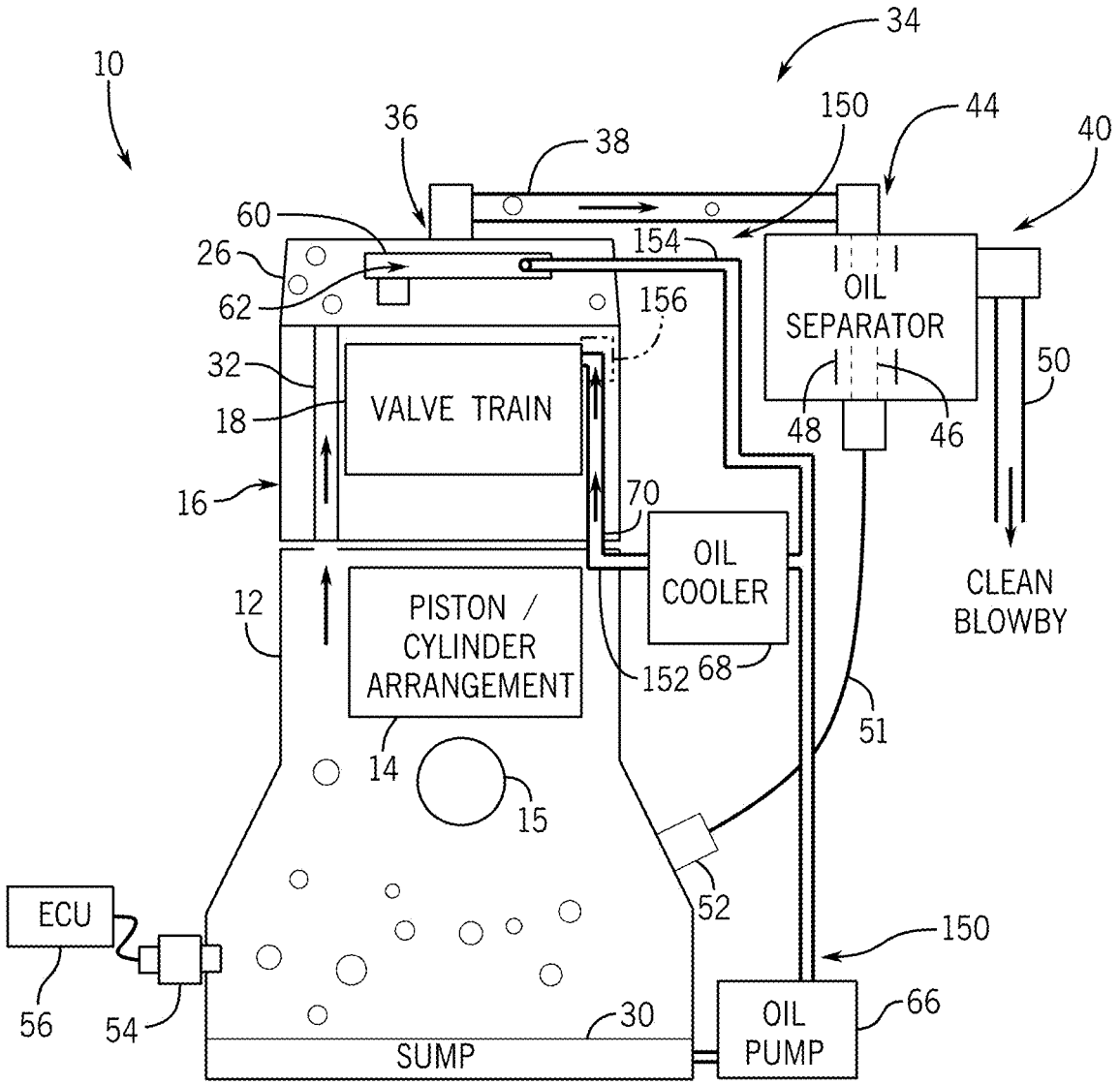
FIG. 9 is a schematic diagram of the internal combustion engine of FIG. 1 and another example engine oil circuit included therein.

FIG. 9 illustrates another engine oil circuit 150 that may be included in the engine 10 to route engine oil to the baffle 60 and the valve train 18. In the engine oil circuit 150, separate circuit paths 152, 154 are provided to circulate oil to the baffle 60 and the valve train 18. The engine oil circulated to the valve train 18 on path 152 may be provided in a manner similar to that shown in FIG. 2, with the engine oil passed through an engine oil cooler 68 and then to a rising line 70 formed through the valve head 16 (and a portion of the crankcase 12). The engine oil that flows up through the valve head 16 via the rising line 70 is provided to the valve train 18, such as via a fitting 156 positioned on the valve head 16. In one embodiment, the fitting 156 is a rocker shaft clamp that mates with the rocker shaft 22 (FIG. 3) to retain the rocker shaft 22 in place relative to the valve head 16 and also directs a flow of engine oil therethrough to provide engine oil to the rocker shaft 22, but in another embodiment (i.e., an overhead camshaft engine) the fitting 156 may provide a flow of engine oil to the valve train 18 via a camshaft and journal bearings. In the engine oil circuit 150 of FIG. 9, the fitting 156 would be configured to include only a single oil passage formed therein that receives engine oil from the rising line 70 and then provides it to the valve train 18.

The engine oil circulated to the baffle 60 on path 154 from the engine 10 is provided directly from the sump 30, without passing through the oil cooler 68 as in the engine oil circuits 64, 134 shown in FIGS. 2 and 7. Accordingly, the engine oil circulated to the baffle 60 has a higher temperature than if it instead were first routed through the oil cooler 68 prior to passing on to the baffle 60, with the engine oil being 15-20° C. higher for example. While engine oil at this higher temperature is not desirable to circulate through the valve train 18, having the engine oil at this higher temperature when it passes through the internal oil passage 62 of the baffle 60 allows for a greater amount of heat transfer between the baffle 60 and the blowby gas, such that the temperature of the blowby gas can be increased further.

Figure 10:
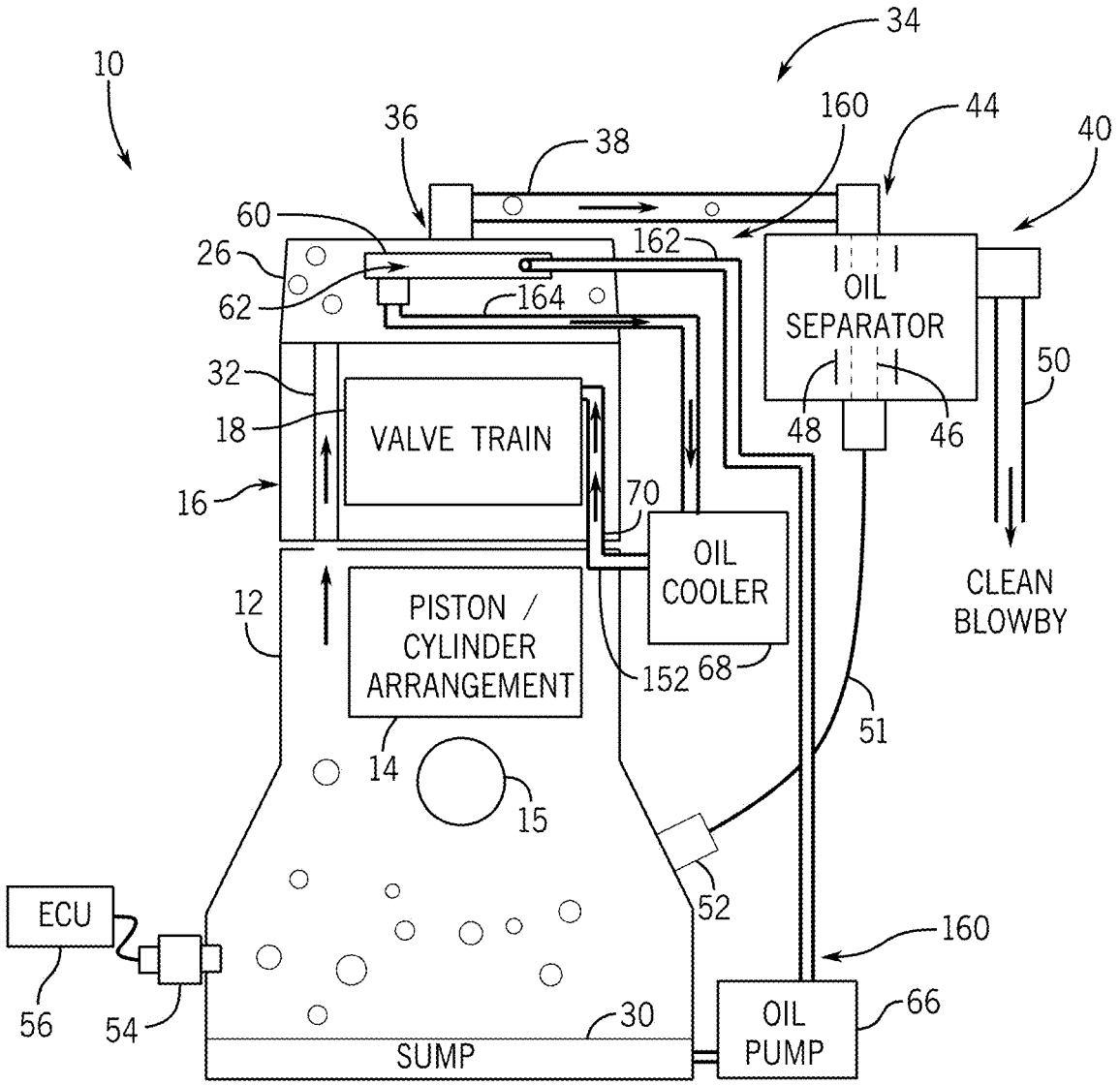
FIG. 10 is a schematic diagram of the internal combustion engine of FIG. 1 and another example engine oil circuit included therein.

In still another embodiment shown in FIG. 10, an engine oil circuit 160 is provided in the engine 10 that routes high temperature engine oil directly to the baffle 60 before being directed thereafter to an engine cooler 68. In the engine oil circuit 160, engine oil is circulated directly to the baffle 60 from the sump 30 via a path 162. The engine oil provided to the baffle 60 is thus at a high temperature (e.g., 15-20° C. higher, for example, than if first passed through an oil cooler) and provides a high degree of heat transfer from the baffle 60 to the blowby gas. After the engine oil circulates through the baffle 60, it exits the baffle 60 and is subsequently routed to the oil cooler 68 via a connecting conduit 164. The engine oil is cooled by the oil cooler 68 to an appropriate temperature and then flows through the rising line 70 formed in valve head 16 and to the valve train 18. As previously described, oil may be provided to the valve train 18 via circulation through a rocker shaft clamp and rocker shaft or may be provided to the valve train 18 via a camshaft and journal bearings, depending on the specific configuration of the engine 10.

In some implementations, existing engines could be retrofitted to benefit from advantages of the invention. As an example, a rocker shaft clamp 76, head cover 26, and baffle 60 as described in FIGS. 3 and 4 could be added to an engine and utilize the existing engine oil circuit 64 therein to provide for heating of the blowby gas generated during operation of the engine. The rocker shaft clamp 76 would divide the engine oil flow between the rocker shaft 22 and the baffle 60, with the mounting of the baffle 60 to the head cover 26 providing for an optimized path for the blowby gas to be run over the baffle 60 before exiting the engine through the blowby outlet 36 of the head cover 26.

Desirably, embodiments of the internal combustion engines described herein utilize engine oil to heat blowby gas generated during operation of the engine, with the blowby gas being heated prior to the blowby gas exiting a blowby gas outlet in a head cover of the engine. The heating of the blowby gas allows for operation of the engine in low temperature environments, such as at temperatures from −10 to −40° C. for example, without vapors in the blowby gas freezing when passing through the filter assembly and being vented to the atmosphere. Accordingly, occurrences of in-field servicing of the engine (resulting from the generation of fault codes associated with clogging of the filter assembly and/or outlet tube from ice and oil slurry in the blowby gas) can be greatly reduced.

Enumerated Examples

The following examples are provided, which are numbered for ease of reference.

1. An internal combustion engine includes a crankcase with a plurality of piston-cylinder arrangements and a valve head positioned above the crankcase at least in part containing a valve train. The internal combustion engine further includes a head cover coupled to the valve head and having a blowby outlet and a baffle positioned between the head cover and the crankcase and defining an oil passage internal to the baffle. Engine oil circulates through the oil passage of the baffle to transfer heat to blowby gas flowing from one or more of the plurality of piston-cylinder arrangements before exiting the valve head through the blowby outlet in the head cover.

2. The internal combustion engine of example 1, further comprising a rocker shaft and a plurality of rocker arms adjacent the valve head and operable to actuate valves in the valve train, wherein the baffle is positioned between the head cover and the rocker shaft.

3. The internal combustion engine of example 2, further comprising a rocker shaft clamp positioned between the valve head and the head cover to retain the rocker shaft, the rocker shaft clamp having a clamp oil passage formed therein to provide the engine oil to the baffle.

4. The internal combustion engine of example 3, further comprising a valve head oil passage formed in the valve head and a head cover oil passage formed in the head cover, wherein engine oil flows from the valve head oil passage, through the clamp oil passage, and to the head cover oil passage, with the engine oil passing from the head cover oil passage into the oil passage of the baffle.

5. The internal combustion engine of claim 3, wherein the rocker shaft clamp directs a flow of engine oil to the baffle, and wherein an oil outlet port of the baffle is fluidly coupled to the rocker shaft so that the flow of engine oil to the baffle is subsequently provided to the rocker shaft.

6. The internal combustion engine of example 3, wherein the rocker shaft clamp further comprises a second clamp oil passage that provides engine oil to the rocker shaft, such that engine oil provided to the rocker shaft clamp is divided between the rocker shaft and the baffle.

7. The internal combustion engine of example 1, wherein the engine oil circulates through an engine oil circuit that draws the engine oil from a sump in the crankcase and circulates the engine oil through the oil passage of the baffle.

8. The internal combustion engine of example 7, wherein the engine oil circuit directs a flow of engine oil directly from the sump to the baffle.

9. The internal combustion engine of example 8, wherein the engine oil circuit directs the flow of engine oil from an outlet port of the baffle, through an oil cooler, and then to the valve train.

10. The internal combustion engine of example 7, wherein the engine oil circuit directs a flow of engine oil from the sump, through an oil cooler, and to the baffle.

11. The internal combustion engine of example 1, wherein the baffle is coupled to a bottom side of the head cover, with a top surface of the baffle and the bottom side of the head cover defining a blowby passage through which the blowby gas flows from the valve head to the blowby outlet.

12. The internal combustion engine of example 11, wherein the blowby passage has a single passage opening through which the blowby gas enters into the blowby passage from the valve head.

13. The internal combustion engine of example 11, wherein the bottom side of the head cover comprises a plurality of blowby gas guides, the plurality of blowby gas guides and the baffle defining a serpentine shape for the blowby passage.

14. The internal combustion engine of example 1, wherein the baffle is formed of a thermally conductive material that transfers heat from the engine oil to the blowby gas.

15. An internal combustion engine includes a crankcase with a plurality of piston-cylinder arrangements and a valve head positioned above the crankcase at least in part containing a valve train. The internal combustion engine further includes a head cover coupled to the valve head and having a blowby outlet formed therein to vent blowby gas flowing from one or more of the plurality of piston-cylinder arrangements and a baffle coupled to a bottom side of the head cover and adjacent the blowby outlet, the baffle defining an oil passage internal to the baffle. Engine oil circulates through the oil passage of the baffle to transfer heat to the blowby gas before exiting the valve head through the blowby outlet in the head cover.

CONCLUSION

The foregoing has thus provided an internal combustion engine that uses engine oil to heat blowby gas generated during operation of the engine, with the blowby gas being heated prior to the blowby gas exiting a blowby gas outlet in a head cover of the engine. A baffle is provided in the engine that is positioned between the head cover and the crankcase of the engine, with engine oil being circulated through an internal oil passage of the baffle. The baffle is positioned in the path of the blowby gas as it migrates up from the crankcase, to the valve head of the engine, and out through the blowby gas outlet in the head cover. As blowby gas is passed over the baffle prior to exiting the blowby gas outlet, heat is transferred from the engine oil, to the baffle, and on to the blowby gas, thereby heating the blowby gas to prevent the freezing of water and oil vapors in the blowby gas.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An internal combustion engine having a crankcase with a plurality of piston-cylinder arrangements and a valve head positioned above the crankcase at least in part containing a valve train, the internal combustion engine further comprising:

a head cover coupled to the valve head and having a blowby outlet; and a baffle positioned between the head cover and the crankcase and defining an oil passage internal to the baffle;

wherein, as engine oil circulates through the oil passage of the baffle, the baffle transfers heat to blowby gas flowing from one or more of the plurality of piston-cylinder arrangements before the blowby gas exits the valve head through the blowby outlet in the head cover.

2. The internal combustion engine of claim 1, further comprising a rocker shaft and a plurality of rocker arms adjacent the valve head and operable to actuate valves in the valve train, wherein the baffle is positioned between the head cover and the rocker shaft.

3. The internal combustion engine of claim 2, further comprising a rocker shaft clamp positioned between the valve head and the head cover to retain the rocker shaft, the rocker shaft clamp having a clamp oil passage formed therein to provide the engine oil to the baffle.

4. The internal combustion engine of claim 3, further comprising:

a valve head oil passage formed in the valve head; and a head cover oil passage formed in the head cover;

wherein engine oil flows from the valve head oil passage, through the clamp oil passage, and to the head cover oil passage, with the engine oil passing from the head cover oil passage into the oil passage of the baffle.

5. The internal combustion engine of claim 3, wherein the rocker shaft clamp directs a flow of engine oil to the baffle, and wherein an oil outlet port of the baffle is fluidly coupled to the rocker shaft so that the flow of engine oil to the baffle is subsequently provided to the rocker shaft.

6. The internal combustion engine of claim 3, wherein the rocker shaft clamp further comprises a second clamp oil passage that provides engine oil to the rocker shaft, such that engine oil provided to the rocker shaft clamp is divided between the rocker shaft and the baffle.

7. The internal combustion engine of claim 1, wherein the oil passage of the baffle receives the engine oil circulated through an engine oil circuit from a sump in the crankcase.

8. The internal combustion engine of claim 7, wherein the engine oil circuit directs a flow of engine oil directly from the sump to the baffle.

9. The internal combustion engine of claim 8, wherein the engine oil circuit directs the flow of engine oil from an outlet port of the baffle, through an oil cooler, and then to the valve train.

10. The internal combustion engine of claim 7, wherein the engine oil circuit directs a flow of engine oil from the sump, through an oil cooler, and then to the baffle and the valve train.

11. The internal combustion engine of claim 1, wherein the baffle is coupled to a bottom side of the head cover, with a top surface of the baffle and the bottom side of the head cover defining a blowby passage through which the blowby gas flows from the valve head to the blowby outlet.

12. The internal combustion engine of claim 11, wherein the blowby passage has a single passage opening through which the blowby gas enters into the blowby passage from the valve head.

13. The internal combustion engine of claim 11, wherein the bottom side of the head cover comprises a plurality of blowby gas guides, the plurality of blowby gas guides and the baffle defining a serpentine shape for the blowby passage.

14. The internal combustion engine of claim 1, wherein the baffle is formed of a thermally conductive material that transfers heat from the engine oil to the blowby gas.

15. An internal combustion engine having a crankcase with a plurality of piston-cylinder arrangements and a valve head positioned above the crankcase at least in part containing a valve train, the internal combustion engine further comprising:

a head cover coupled to the valve head, the head cover having a blowby outlet formed therein to vent blowby gas flowing from one or more of the plurality of piston-cylinder arrangements; and a baffle coupled to a bottom side of the head cover and adjacent the blowby outlet, the baffle defining an oil passage internal to the baffle;

wherein, as engine oil circulates through the oil passage of the baffle, the baffle transfers heat to the blowby gas before the blowby gas exists the valve head through the blowby outlet in the head cover.

16. The internal combustion engine of claim 15, further comprising:

a rocker shaft and a plurality of rocker arms positioned adjacent the valve head and operable to actuate valves in the valve train; and a rocker shaft clamp having one or more clamp oil passages formed therein to direct a flow of engine oil to the baffle or to both the baffle and the rocker shaft.

17. The internal combustion engine of claim 16, wherein the rocker shaft clamp comprises a first clamp oil passage and a second clamp oil passage, with engine oil provided to the rocker shaft clamp being divided between the rocker shaft and the baffle.

18. The internal combustion engine of claim 16, wherein the rocker shaft clamp comprises a single clamp oil passage that directs engine oil entirely to the baffle, and wherein an outlet of the oil passage internal to the baffle is fluidly coupled to the rocker shaft so that the engine oil circulated through the oil passage of the baffle is subsequently provided to the rocker shaft.

19. The internal combustion engine of claim 16, wherein the head cover includes a head cover oil passage formed therein that is connected to one of the one or more clamp oil passages of the rocker shaft clamp to fluidly couple the rocker shaft clamp to the oil passage of the baffle.

20. The internal combustion engine of claim 15, wherein the bottom side of the head cover comprises a plurality of blowby gas guides that, along with a top surface of the baffle, define a serpentine-shaped baffle blowby passage through which blowby gas flows to the blowby outlet.

* * * * *